US006079848A

United States Patent [19]

Ahroni

[11] Patent Number: 6,079,848

[45] **Date of Patent: *Jun. 27, 2000**

[54] LAMP UNIT WITH IMPROVED PUSH-IN TYPE BULB HOLDER

[76] Inventor: Joseph M. Ahroni, 2701 W. Manor Pl., #204, Seattle, Wash. 98199

[ * ] Notice: This patent is subject to a terminal disclaimer.

[21] Appl. No.: 09/113,574

[22] Filed: Jul. 10, 1998

Related U.S. Application Data

[63] Continuation-in-part of application No. 08/675,549, Jul. 3, 1996, Pat. No. 5,829,865.

[51] Int. Cl.[7] ..... F21V 21/00

[52] U.S. Cl. ..... 362/249; 362/226; 362/391; 362/806; 439/391; 439/611; 439/699.1; 439/404

[58] Field of Search ..... 362/226, 239, 362/249, 250, 391, 806; 439/404, 611, 391, 393, 395, 699.2, 419, 243, 619

[56] References Cited

U.S. PATENT DOCUMENTS 4,777,573 10/1988 Liao ..... 362/249
5,109,324 4/1992 Ahroni ..... 362/249
5,580,159 12/1996 Liu ..... 362/226
5,622,425 4/1997 Lin ..... 362/249
5,697,698 12/1997 Huang ..... 362/226
5,829,865 11/1998 Ahroni ..... 362/226

*Primary Examiner*—Sandra O'Shea
*Assistant Examiner*—Ali Alavi
*Attorney, Agent, or Firm*—Seed IP Law Group PLLC

[57] ABSTRACT

A light set has multiple light units mounted on a multi-wire insulated cord, each light unit comprising a plastic push-in lampholders containing a bulb with two lead wires, a socket member receiving a pair of push-in contact elements and lampholder, and a base unit which snaps together with the socket member over the cord preparatory to insertion of the contact elements and lampholders. The contact elements pierce the cord insulation on opposite sides of a cutout through a selected one of the cord wires and establish positive contact with both parts of the severed wire by straddling respective of the wire parts with a pair of sharp prongs. Positive positioning of the bulb leads with respect to the contact elements is established by flexible leg extensions on the lampholders which interfit at their free ends with the leads and swing back to a position in the socket member pressing the leads against the contact elements.

11 Claims, 4 Drawing Sheets

LAMP UNIT WITH IMPROVED PUSH-IN TYPE BULB HOLDER

CROSS-REFERENCE TO RELATED APPLICATION

This application is a continuation-in-part of my application Ser. No. 08/675,549, filed Jul. 3, 1996, and now U.S. Pat. No. 5,829,865.

TECHNICAL FIELD

The present invention relates to miniature decorative light sets with push-in type bulb holders in which lead wires from the bulbs are pressed into engagement with contact elements within the sockets receiving the bulb holders.

BACKGROUND OF THE INVENTION

It is common in decorative light strings to have light units comprising miniatures bulbs each seated in a socket provided by a holder which has a push-in fit with a housing having a socket containing two contact elements extending into a wireway in the base of the housing. The contact elements engage wires of the light string extending through the wireway. Each bulb has a pair of fine single-strand wire leads extending from the bulb through the base of the holder and doubled back about one-half inch against the outside of the holder so as to be pressed into engagement with the contact elements when the holder is pushed into the holder socket. Assembly of the bulb in the holder and the mounting of the bulb and holder in the housing are performed manually and require deft manipulation of the lead wires. Consequently, the doubled back portion of each bulb lead does not always end up in a position generally parallel to the longitudinal axis of the respective holder when the bulb is pushed into the housing socket. As a result there may be in some instances no initial contact between the lead and the respective contact element or later loss of contact after assembly during handling of the respective light set.

SUMMARY OF THE INVENTION

The present invention aims to provide an improved arrangement for positioning the bulb lead wires in engagement with the contact elements in the housing. This involves adding a pair of flexible longitudinal extensions to the bulb holders as legs which can easily be bent to assume a position between the bulb holder and contact elements when the bulb holder and bulb are inserted as a push-in unit in the light housing. Each extension has a slot at its free end arranged so that a respective bulb lead feeding from the holder can have a terminal end portion positioned in the slot and doubled-back to initially position an intermediate portion of the lead against the respective leg.

DETAILED DESCRIPTION OF THE INVENTION

Figure 1:
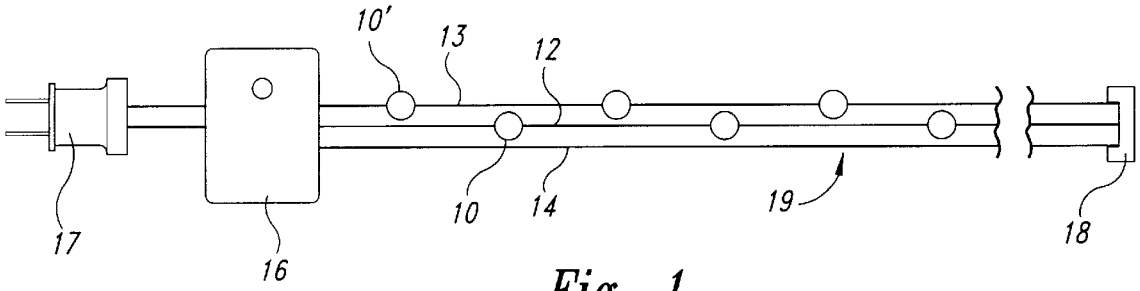
FIG. 1 is a layout of a light set using the light units of the present invention.
Figure 2:
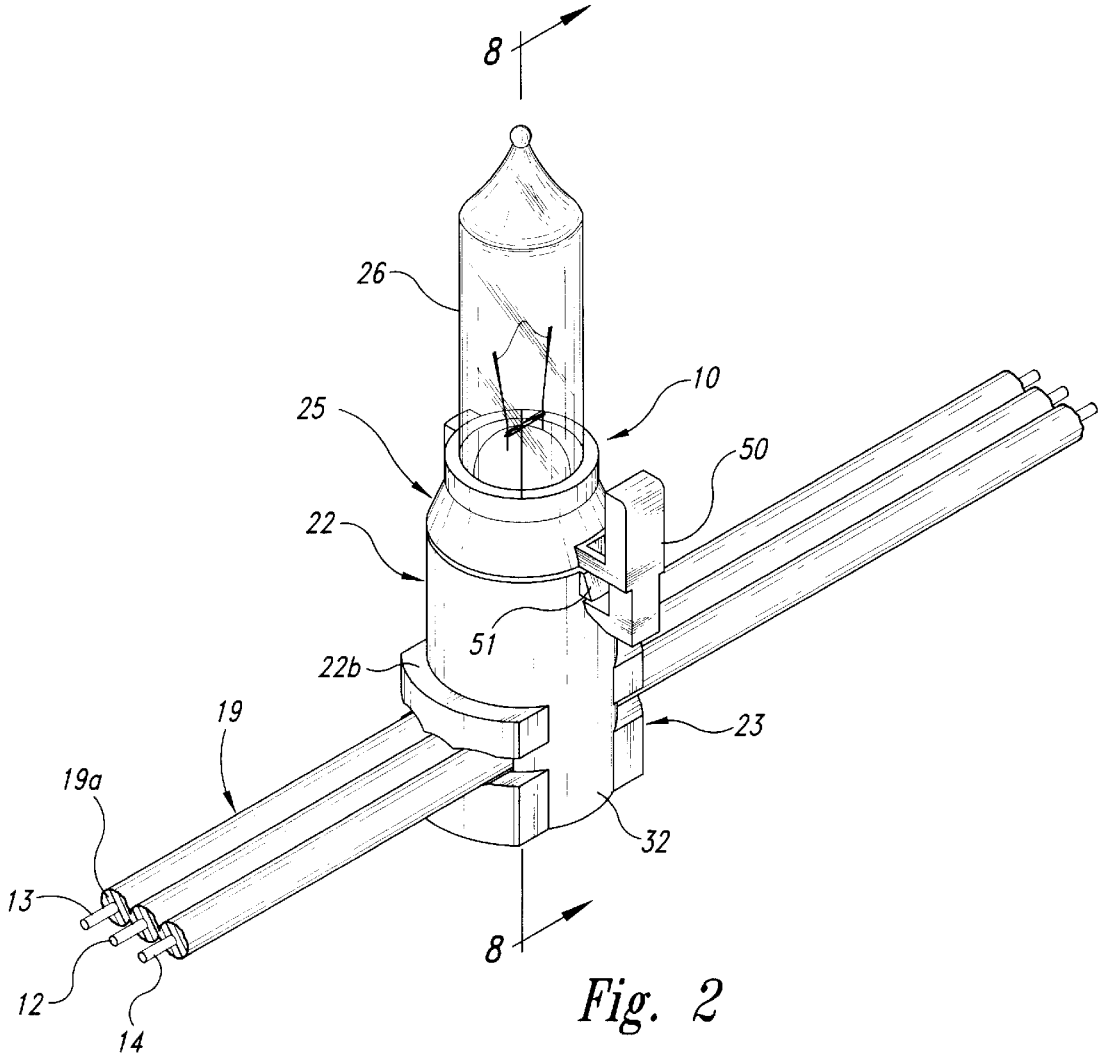
FIG. 2 is a perspective view of one of the light units mounted on a cord.

For purpose of example, lampholders embodying the present invention are illustrated as applied to a chaser set having two series of light units 10, 10' on two interrupted wires 12–13. These wires and a return wire 14 extend from a controller 16 in turn connected to a wall plug 17. At their outer ends the wires 12–14 are connected together within a suitable insulated shield 18. The controller 16 contains a switching mechanism for alternately completing a circuit to the wires 12–13.

The wires 12–14 are arranged in side-by-side spaced relation as part of a single cord 19 having insulation 19*a* surrounding and separating the wires. The cord 19 passes through a wireway 20 in each light unit 10–10', and the wires 12–13 are sectioned by respective cutouts 21 in the cord which are positioned in the wireways 20 of the light units 10–10'. Each cutout 21 extends through only the respective wire 12–13 and the related external insulation. The resulting gap between the wire segments on each side of the cutouts is bridged via a pair of contact elements and the leads from the filament of the bulb in the light unit in a manner to be described. The light units 10 and 10' are basically the same, the principal difference being that the contact elements for the light units 10' are modified to engage outer wire 13 rather than the center wire 12.

The light units 10 include an injection-molded two-piece plastic lampholder housing consisting of a socket unit 22 and a generally U-shaped base unit 23 which have a snap interfit and provide complementing gripping jaw portions 22'–23' forming the wireway 20 for passage of the cord 19. The wireway 20 is shaped by a set of three arcuate grooves 20*a* extending across the jaw portion of the socket unit 22 and a complementary set of three arcuate grooves 20*b* extending across the jaw portion 23' of the base unit 23. Within the wireway 20 the insulation 19*a* of the cord 19 is firmly gripped and compressed between the opposing jaw portions 22', 23'. the socket unit 22 has a pair of oppositely projecting flanges 22*b* providing end portions of the jaws 22' and grooves 20*a*. A socket cavity 22*a* extends along the length of the socket unit 22 for receiving a push-in bulb assembly 24 having an injection-molded plastic bulb holder 25 in which a bulb 26 with a pair of leads 27 from its filaments is mounted. Each light unit 10 is completed by a pair of elongated push-in contact elements 28 located at opposite sides of the socket cavity 22*a* and arranged to extend crosswise into the wireway 20. The contact elements 28 for the light units 10 are energized via the center wire 12 and fit into diametrically opposite guideways 29. The contact elements for the light units 10' which are energized via the wire 13 are wider and fit into a wider guideway provided in the socket cavity of a socket unit modified in that respect (not shown).

Projecting from the socket unit 22 on opposite sides of the wireway 20 are two locking legs 32 presenting opposed locking shoulders 32*a* adjacent their outer end for interfitting with the base unit 23. These shoulders 32*a* are adjoined by beveled lead-in faces 32*b*. The inner face of each locking leg 32 is transversely concave matching the curvature of the socket cavity 22*a*.

Figure 3:
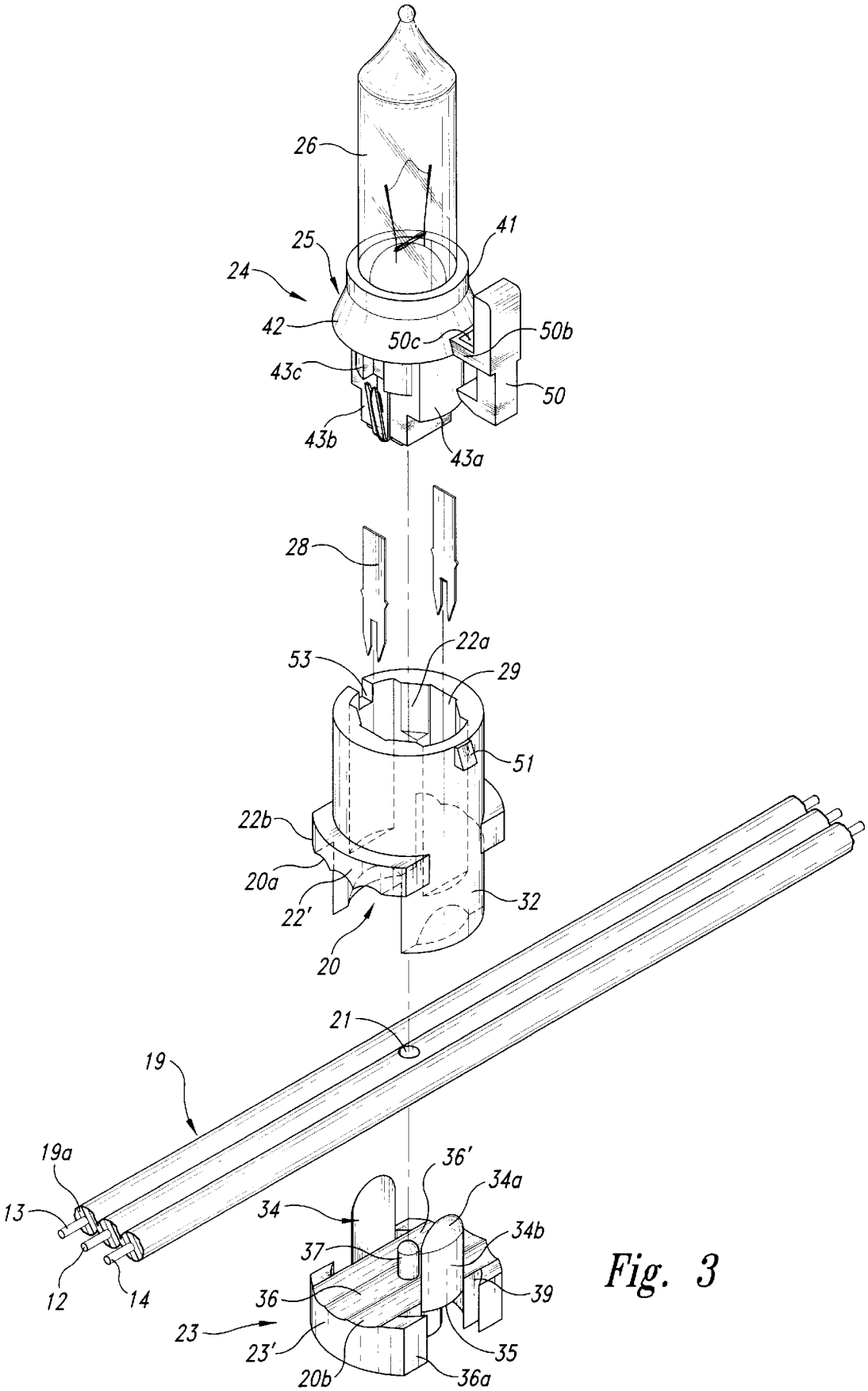
FIG. 3 is an exploded view of one of the light units in the center series of light units in FIG. 1.

The base unit 23 has a pair of flexible guide fingers 34 shaped to engage the lead-in faces 32*b* and be flexed at their root end toward one another responsive to pushing of the base unit 23 and socket housing 22 together from opposite sides of the cord 19 after the base unit 23 has been positioned with the cord 19 straddled by the fingers 34 at the site of one of the cutouts 21. At their root end the fingers 34 have retaining shoulders 35 between a respective pair of curved base flanges 36, 36'. These shoulders 35 are engaged by the locking shoulders 32*a* when the base unit 23 and socket unit 22 are snap-fitted together over the cord 20. The guide fingers 34 are preferably arched transversely to provide each with a convex outer guide face 34*a* complementing the concave inner guide face of the respective locking leg 32, and the free end of each guide finger 34 is preferably rounded and beveled on its convex outer side as indicated at 34*b*. The base unit 23 presents a post 37 arranged between the fingers 34 to project into a selected cutout 21 in the cord 19. Two forms of base unit 23 are required, one for lights 10 with its post 37 arranged to extend through the cutout 21 in the center wire 12, as shown in FIG. 3, and the other for lights 10' to project through a cutout in wire 13.

Figure 9:
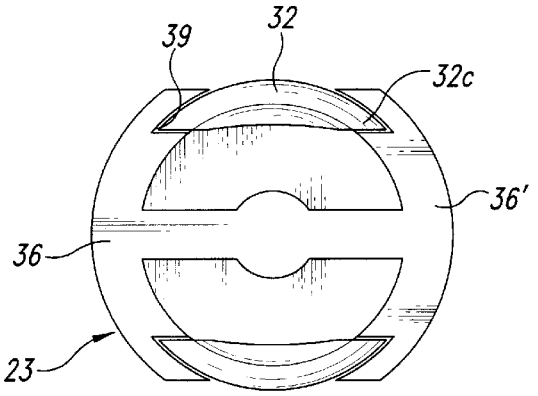
FIG. 9 is a bottom view of one of the light units mounted on a cord.

The flanges 36, 36' on the base unit 23 each have curved wings 36*a* which define retaining recesses 39 that are generally V-shaped in plan view. As seen in FIG. 9, these recesses 39 receive side edge portions 32*c* of the locking legs 32 so that the curved base flanges 36, 36' keep the locking legs 32 from spreading apart after the base unit 23 and socket unit 22 are fitted together.

Figure 4A:
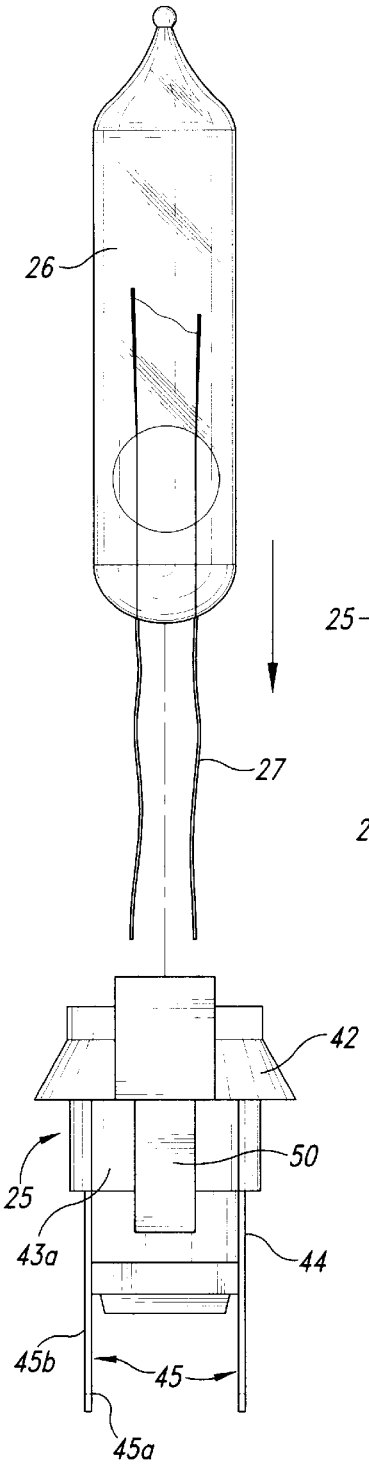
FIG. 4A is an elevational view of a plug-in bulb holder assembly shown in exploded relation with a bulb in position for assembly therewith.
Figure 5:
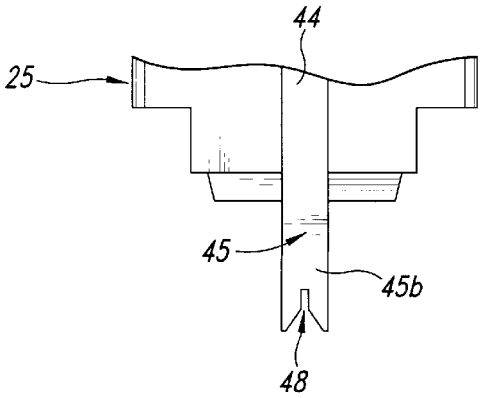
FIG. 5 is a detail side elevational view of the lower portion of the lamp holder as viewed at the left side of FIG. 4A.
Figure 6:
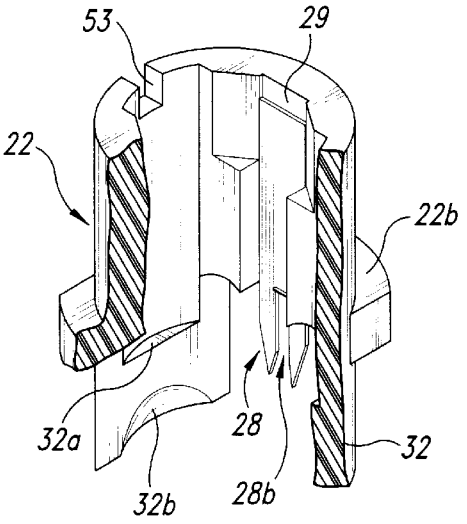
FIG. 6 is a detail sectional view through the socket unit of the holder with a contact element in place.

The bulb holder 25 has a central socket 40 to receive the bulb 26. This socket 40 is provided in a round head portion 41 having an outwardly flared annular rim 42. Below the rim 42 the bulb holder has a longitudinal section 43 presenting a pair of convex longitudinal faces 43*a* between a wider pair of flat longitudinal faces 43*b*, each of which is interrupted by a pair of laterally spaced longitudinal ribs 43*c*. Extending longitudinally from between each of these pairs of ribs 43*c* is a narrow flat land 44 which continues endwise beyond the adjacent end of the lamp holder as longitudinal flexible legs 45. These legs 45 initially are in generally parallel spaced relation as indicated in FIG. 4A. A longitudinal center passage 46 extends from the socket 40 through most of the remaining length of the bulb holder and exits through a pair of exit ports located adjacent the root ends of the legs 45. As shown in FIG. 5, the outer end of each leg 45 is preferably formed with a positioning slot 48 extending between flat inner and outer exterior faces 45*a*, 45*b* of the leg.

Figure 4B:
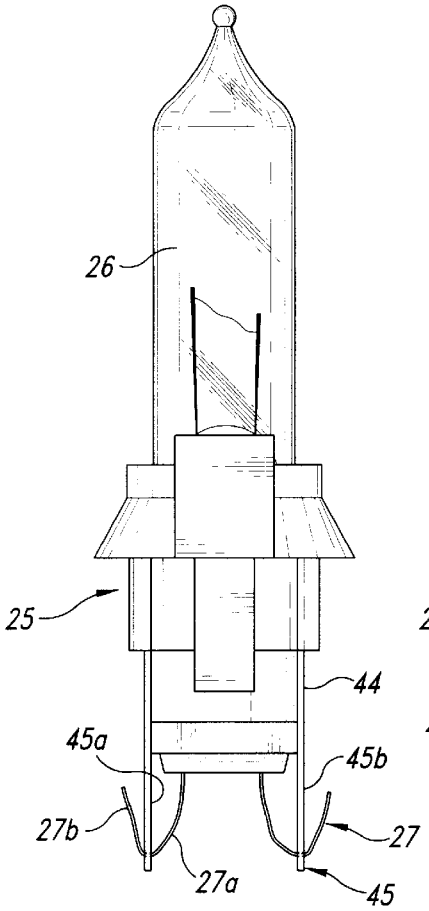
FIG. 4B is an elevational view showing the bulb in place with the bulb holder and the lead wires of the bulb engaging the flexible legs of the holder.

When the bulb 26 is being positioned in the bulb holder 25, the lead wires 27 are fed through the passage 46 and exit ports at the lower end of the passage to extend adjacent the inner faces 45*a* of the legs 45 to the positioning slots 48 by an intermediate lead section 27*a*. Then a short end portion 27*b* of the leads are bent to pass through the slot 48 and double back over the outer faces 45*b* of the legs as shown in FIG. 4B. It is preferred to have the ends of the slot 48 narrow to a width which will cause the lead wires 27 to be pinched where they pass through the slots to be doubled back over the outer faces 45*b*.

Figure 4C:
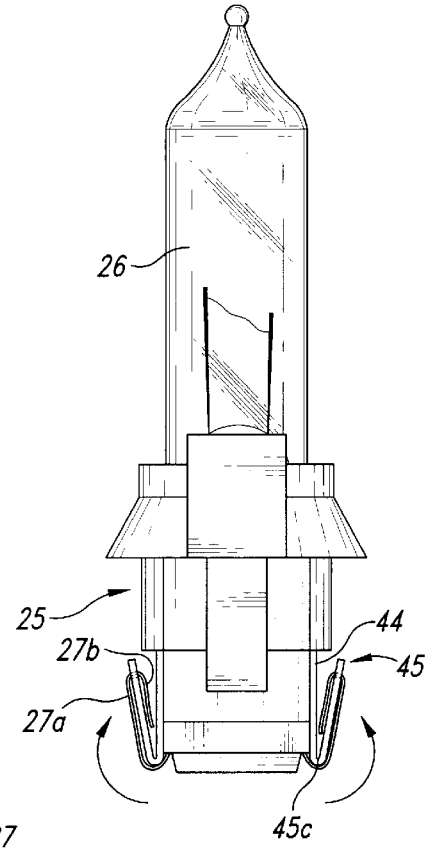
FIG. 4C is an elevational view like FIG. 4B, but showing the flexible legs of the bulb holder bent back in preparation for introduction of the bulb holder and bulb as a unit to the socket unit.

When the described arrangement of the lead wires 27 and flexible legs 45 has been accomplished, the legs 45, with the lead wires 27 in position thereon, can then be bent outwardly away from one another at their root ends and doubled back toward the body extension 44 as illustrated in FIG. 4C. This repositions the inner faces 45*a* of the legs 45 so that they face outwardly away from one another rather than facing inwardly toward one another as they were initially. This also repositions the intermediate sections 27*a* of the lead wires 27 so that they are exposed outwardly of the bent legs 45, and repositions the end portions 27*b* of the lead wires so that they are located between the initially outer faces 45*b* of the legs 45 and the adjacent outer face of the land 44. When the legs 45 are fully bent to the described double-back positions, the distance between the leg faces 45*b* is slightly less than the spacing between the contact elements 28 at opposite sides of the socket cavity 22*a*. This provides adequate space for the intermediate lead sections 27*a* which are pinched between the bent legs 45 and the contact elements 28 when the light units are assembled. It will be noted that the configuration of the bulb holder 25 and its flexible legs 45 is such that they can be injection molded as a one-piece part.

The bulb holder 25 is preferably provided with a locking finger 50 which projects from the annular rim 42 and has an inturned locking element 50*a* which is tapered at its bottom side. The locking finger is arranged to spring apart as it rides over a sloped entry ramp 51 on the socket housing 22 when the bulb holder 25 is pushed into the cavity 22*a*. Then the locking finger 50 springs inwardly at the outer end of the ramp 51 so that the locking element 50*a* engages a stop shoulder 52 beneath the ramp. The locking finger 50 has a pair of fork arms 50*b* which connect to the rim 42 of the bulb holder 25 and are separated by an opening 50*c* which overlies the locking element 50*a*. This arrangement makes it possible to injection mold the locking finger as an integral part of the bulb holder 25.

The ramp 51 is preferably located in alignment with one of the locking legs 32. Diametrically opposite the ramp 51 is a keyway 53 for receiving a positioning key 54 projecting radially from the bulb holder 25 at the base of the rim 42. The positioning key 54 and keyway 53 prevent the bulb unit 24 from being improperly positioned in the socket unit 22.

Figure 7:
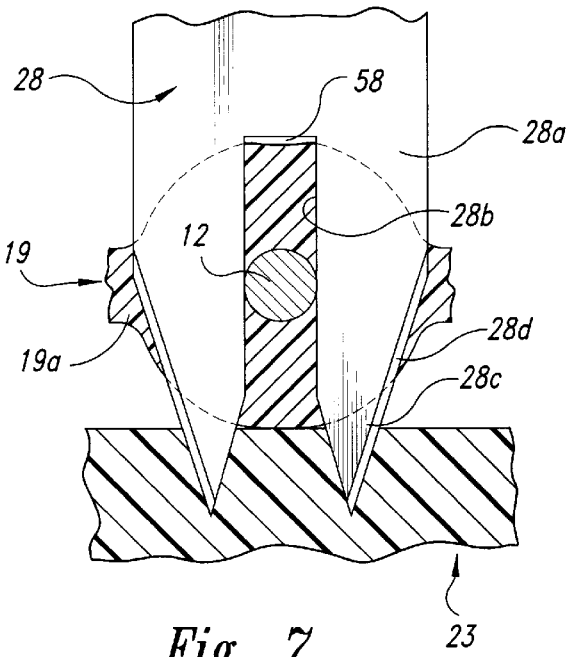
FIG. 7 is a detail view showing in elevation the lower end portion of one of the contact elements installed and with the related cord shown in transverse cross section.
Figure 8:
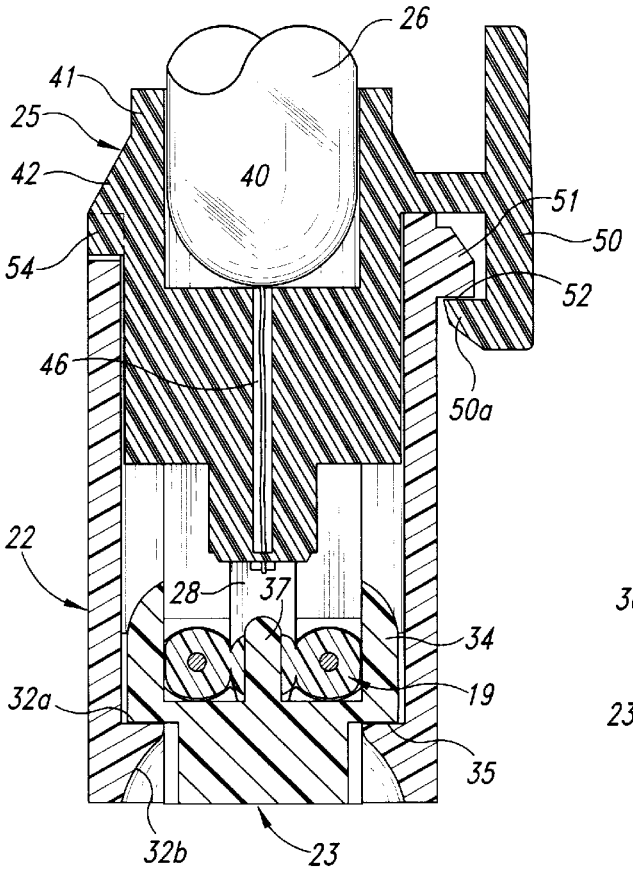
FIG. 8 is a longitudinal vertical sectional view taken as indicated by line 8—8 in FIG. 2.

Referring to FIG. 7, the contact elements 28 are bifurcated at their lead-in ends to provide a pair of prongs 28*a* which are separated by a slot 28*b* and have V-shaped insulation shearing end portions 28*c* preferably sharpened along their outer edges 28*d*. As indicated in FIG. 7, the prongs 28*a* are designed to straddle and engage wire 12, for example, when the prongs pierce the insulation 19*a* of the cord 19 as the contact element 28 is pushed along a guideway 29 into the wireway 20 sufficiently for the tips of the prongs to bite into the plastic of the base wall of the base unit 23. Preferably, the outer longitudinal edges of the contact elements 28 are provided with one or more pairs of hold-in barbs shaped to bite into the adjoining inner portions of the socket unit 22.

Each contact element 28 is preferably provided with a blunt crimping element 58 at the closed end of the slot 28*b*. This crimping element 58 is positioned so that it engages the insulation 19*a* on the particular wire 12–14 straddled by the prongs 28*a* and presses (crimps) the insulation and wire together against the base unit 23 as indicated in FIG. 7. This pinches the insulation against the wire and assists in keeping the wire in proper position in electrical contact between the prongs 28*a*. The crimping element 58 is formed as an integral flange portion of the contact element during the stamping operation on thin metal brass stock. Preparatory to mounting the light units 10, 10' on the cord 19, the cord is passed through a suitable punching machine to make the cutouts 21 which are in alternating relation. Each light unit is then mounted by first positioning its base unit 23 beneath the cord with its post 37 projecting upwardly through the respective cutout 21. Then, after the socket unit 22 has been positioned above the cord in proper alignment with the base unit 23, the units 22–23 are pressed longitudinally together so that the locking shoulders 32*a* on the locking legs 32 of the socket unit are engaged by the retaining shoulders 35 at the root ends of the guide fingers 34 of the base unit 23. During this socket unit and base unit assembly operation the beveled lead-in face 32*b* on the locking legs 32, the rounded nose and adjoining bevel 34*b* on the guide fingers 34, and the complementing concave and convex shapes of the inner face of the locking legs 32 and outer face of the guide fingers 34 are of substantial assistance in properly aligning and guiding the parts. After a lampholder is mounted on the cord, the contact elements 28 are inserted by a suitable insertion machine through the open mouth of the socket unit 22 and along the guideways 29 so that the prongs 28*a* pierce the insulation 19*a*, straddle the wire and preferably bite into the base unit 23, and so that the crimping elements 58 press against the cord insulation 19*a*. It is important that while the prongs 28*a* pierce the cord insulation 19*a*, the sloped outer cutting edges 28*d* tend to be urged toward one another, thereby resisting spreading apart of the prongs 28*a*. With this arrangement of the contact elements 28 together with the cord clamping action of the interfitted socket and base units at each end of the wireway 20, the contact elements are maintained in engagement with the respective wire.

Assembly is completed by inserting the bulb assemblies 24 into the socket units 22 with the keys 54 seated in the keyways 53 and the locking fingers 50 engaging the stop shoulders 52. As previously discussed, when the bulb assemblies 24 have been prepared for insertion into the socket units 22 the legs 45 have been bent at their root ends such as to be doubled back toward the lands 44*a*. Normally when this is done there will be an acute angle between each leg 45 and the respective land 44*a* as shown in FIG. 4C. As the bulb assemblies are pushed into the socket units 22 the elbow portions 45*c* of the legs 45 are squeezed and the legs 45 are forced toward the lands 44 so that when the legs reach a position opposite the contact elements 28 the intermediate sections 27*a* of the leads are pressed firmly against the contact elements 28 and the end portions 27*b* of the leads are clamped between the legs 45 and the underlying flat lands 44 on the bulb holder 25.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I what is claimed is:

1. A lamp unit comprising:

a housing providing a wireway at one end and a socket at the opposite end;

a pair of elongated contacts extending along opposite sides of said socket and extending into said wireway; and a plug-in holder seated in said socket and a bulb seated in said holder, said bulb having a pair of leads extending from the bulb and passing longitudinally through said holder toward said wireway to provide exposed lead portions which are bent back between said holder and contacts to engage said contacts, said holder having a pair of integral flexible extensions each with a root end and a free end, said extensions being doubled back between said contacts and holder at said root ends and engaging said lead portions to keep them in engagement with said contacts.

2. A lamp unit according to claim 1 in which said free ends of said extensions are formed with a positioning slot through which a free end portion of the respective said lead wire extends and bends back to occupy a position between the respective extension and the holder.

3. A lamp unit according to claim 1 in which said extensions occupy longitudinal grooves in said holder occupied by said contacts.

4. A bulb holder comprising:

a one-piece molded plastic housing having a head, a body necked down from said head, and a pair of legs extending at root ends from said body oppositely from said head, said legs having first sides which initially face toward one another and having second sides located oppositely from said first sides;

said legs being formed with end slots between their said sides;

said head being formed with a socket to receive a bulb;

said body having a wireway extending from said socket and exiting between said root ends for receiving a pair of lead wires projecting from the bulb and passing from said wireway along said first sides by contact portions, then through said end slots, and finally doubling back along part of said second sides; and said legs being flexible so as to be adapted to be bent outwardly at said root ends and back toward said head to thereby expose said contact portions of the bulb leads.

5. A bulb and holder unit comprising:

a bulb having a base end with a pair of lead wires extending therefrom;

a bulb holder having a head, a body necked down from said head, and a pair of legs extending at root ends from said body oppositely from said head and having outer ends;

said legs having first sides which initially face toward one another and having second sides located oppositely from said first sides;

said legs being formed at their outer ends with slots between their said sides;

said head being formed with a socket receiving said bulb, and said body having a wireway extending from said socket and exiting between said root ends for receiving said lead wires;

said lead wires projecting from the bulb and passing from said wireway along said first sides by contact portions, then through said end slots, and finally doubling back by end portions along part of said second sides; and said legs being flexible so as to be adapted to be bent outwardly and back to rest against said head to thereby expose said contact portions of the bulb leads for engagement with contacts and to thereby position said end portions between said second sides and said body.

6. A light set comprising:

a lampholder with a tubular socket member having an entry end and having a pair of locking legs extending from the opposite end and presenting beveled lead-in faces at their free ends joining locking shoulders between the legs which are spaced from the free ends of the legs;

a base member having a pair of guide fingers projecting between said legs and having retaining shoulders at the base end of the fingers which are engaged by said locking shoulders, said legs and guide fingers having a snap fit with one another when the socket member and base member are pushed endwise forward one another with said fingers positioned between said legs and engaging said lead-in faces, and free end portions of said legs interfitting with said base member adjacent said guide fingers such that said base member prevents spreading apart of said legs;

a wireway between said fingers and between said socket member and said base member;

a pair of contact elements mounted in a socket in said socket member and projecting into said wireway for engaging an interrupted wire extending through said wireway and interrupted between said contact elements;

and a push-in bulb assembly plugged into said socket member from said entry end and having a bulb with a pair of wire leads engaging said contact elements.

7. A light set according to claim 6 in which said base member has recesses outwardly of opposite longitudinal side edges of said guide fingers which are defined by retaining wings projecting from said base member, said recesses receiving said free end portions of said locking legs, and said wings preventing spreading apart of said locking legs.

8. A light set according to claim 6 in which an electrical cord having multiple side-by-side wires separated by insulation extends through said wireway and provides said interrupted wire, and said contact elements each have a pair of spaced-apart pointed prongs cutting through said insulation and straddling and engaging said interrupted wire, said prongs each having an outer sharp cutting edge which slopes inwardly toward a pointed end of the respective prong whereby the prongs are urged toward one another responsive to cutting of the insulation by the prongs when the prongs are pushed endwise into the wireway from said socket member before said bulb assembly is plugged into the socket member.

9. A light set according to claim 7 in which said bulb assembly has a bulb holder for said bulb, said holder having a pair of integral flexible extensions, said extensions being doubled back between said contacts and said holder and engaging portions of said leads such as to keep them in engagement with said contacts.

10. A light set comprising:

a lampholder housing providing a transverse wireway at a base end thereof and a socket with an entry at the opposite end thereof, said housing having a base wall along said wireway;

a cord extending through said wireway, said cord having side-by-side wires separated and enclosed by insulation;

a pair of elongated contact elements at opposite sides of said socket and projecting into said wireway into engagement with one of said wires at opposite sides of an interruption in such wires, said contact elements each having a pair of spaced-apart pointed prongs cutting through said insulation and straddling said interrupted wire, said prongs each having an outer sharp cutting edge which slopes inwardly toward a pointed end of the prong whereby the prongs are urged toward one another and the interrupted wire responsive to cutting of the insulating by the prongs when the contact elements are pushed endwise into the wireway from said sockets;

and a push-in-bulb assembly seated in said socket and presenting two light bulb leads at opposite sides thereof engaging respective of said contact elements.

11. A lampholder comprising:

a plug-in type body having a socket open to one end of the body and having a pair of openings at the opposite end of the body connecting with said socket for the passage of a pair of lead wires from a bulb seated in said socket;

a pair of flexible legs extending from said opposite end and notched at their free ends to receive the lead wires, said legs being sufficiently flexible to be adapted to be folded back against said body.

* * * * *